United States Patent [19]

Reichardt et al.

[11] Patent Number: 4,744,772

[45] Date of Patent: May 17, 1988

[54] CONNECTOR FOR FLAT CABLE TERMINATION

[75] Inventors: Manfred Reichardt, Weinsberg; Eberhard Raab, Untereisesheim, both of Fed. Rep. of Germany

[73] Assignee: Amphenol Corporation, Wallingford, Conn.

[21] Appl. No.: 22,900

[22] Filed: Mar. 6, 1987

[30] Foreign Application Priority Data

Mar. 6, 1986 [DE] Fed. Rep. of Germany ..... 3607409

[51] Int. Cl.[4] ..... H01R 11/20

[52] U.S. Cl. ..... 439/405

[58] Field of Search ..... 439/395, 404, 405, 417, 439/418

[56] References Cited

U.S. PATENT DOCUMENTS 4,437,723 3/1984 Narozny ..... 439/404

FOREIGN PATENT DOCUMENTS 3443235 6/1986 Fed. Rep. of Germany .

*Primary Examiner*—Neil Abrams

*Attorney, Agent, or Firm*—Bacon & Thomas

[57] ABSTRACT

A connector (51, 86) is provided having a plurality of contact elements (53), the contact elements comprising plug-in elements (55) arranged in three rows (58, 59, 60) with a first pitch, insulation displacement contacts (54) arranged in two parallel rows (56, 57) with a second pitch different from the first pitch.

20 Claims, 3 Drawing Sheets

CONNECTOR FOR FLAT CABLE TERMINATION

BACKGROUND OF THE INVENTION

1. Field of the Invention

The present invention relates generally to a connector for flat cable termination. More particularly, the present invention relates to a so-called three-row connector having contact elements which are arranged with distances from each other which differ from the distances with which the wires of a flat cable are arranged.

2. Description of the Prior Art

Generally speaking, the present invention relates to a multi-row connector. More particularly, however, the present invention relates to a three-row connector of the insulation displacement type. Connectors of the latter type are, for instance, described in German Industrial Standard DIN 41652.

A connector having three rows of contact elements is already known, and it is further known to assign to each of said rows of contact elements a corresponding row of termination means having insulation displacement contacts. Accordingly, in each one of the three rows of contact elements a pitch or distance $t_2$ (of 2.80 mm) is maintained on the plug-in side of the connector, while at the termination side of the connector the pitch or distance between the insulation displacement contacts is $3 \times t_1$ (of 3.81 mm), with $t_1$ being the so-called cable pitch, i.e. the distance between the wires provided in the flat cable. In each row of insulation displacement contacts every third wire of the flat cable is terminated. The distance (pitch) $t_1$ is referred to by the reference numeral 64 in FIG. 6.

The distance $t_2$ (of 2.80 mm) on the plug-in side of the connector allows only a one-legged female contact element. In fact, a closed female contact sleeve (in the form of a tulip) would require twice the amount of material, i.e. $2 \times t_2$. In addition, the use of three rows of insulation displacement contacts on each comb formed by the contact elements wastes space between the contact elements.

According to another known connector design female contact elements having two legs are used. For this purpose each of the three rows of contact elements is comprised of two contact combs. As a consequence, the distance (pitch) of the male contact elements (or the distance of the contact elements) is $2 \times t_2$ per comb and allows for the required material to provide the tulip shape. However, this arrangement requires 6 contact combs.

It would be desirable to provide a connector, in particular, a connector for the flat cable termination, for which the problem of adaptation between the distance of the contact elements and the different distance between the wires of the cable is solved in a simple manner. It would also be desirable to provide a connector which fulfills on its plug-in side the requirements of the German Industrial Standard DIN 41652. Additionally, it would be desirable to provide a connector that can be manufactured at low cost and with a minimum amount of material, and uses a small number of low cost standard components.

Furthermore, it would be desirable to provide a connector which does not require the presence of otherwise unused space when providing the insulation displacement termination means, and to avoid waste material caused by the stamping operation of the contact elements.

Finally, it would be particularly desirable to provide the contact elements with female contact means having at least two independently effective springy (resilient) legs. Generally, the female contact elements (or sockets) require more material than the male contact means (pins).

SUMMARY OF THE INVENTION

In accordance with the present invention, there is provided a connector having a plug-in or connecting side and a termination side, a termination side being adapted for flat cable termination, the connector comprising a plurality of contact elements, each of the contact elements comprising a plug-in element on the plug-in side of the connector, insulation displacement means on the termination side of the connector and connecting means arranged between the plug-in elements and said insulation displacement means.

The present invention provides a connector having plug-in contact elements (male or female) which are arranged in three rows. The adaptation between the different distances of the plug-in contact elements and the distances of the wires or conductors in the flat cable is provided for within the connector. The termination elements provided in the form of insulation displacement means are arranged in two rows of termination elements, in particular two rows of insulation displacement contacts. In each row of insulation displacement means the insulation displacement contacts have a distance of $2 \times t_1$, and said two rows are offset with respect to each other by $t_1$.

Connecting means provide the adaptation between the different pitches, and preferably such means includes separate connecting means on the plug-in elements and on the insulation displacement contacts, which are connected to each other. The plug-in elements preferably have both short and long connecting legs.

DESCRIPTION OF THE PREFERRED EMBODIMENTS

Initially, a first embodiment of the invention will be described in connection with FIGS. 1 to 5 and, thereafter, a second embodiment will be described in connection with FIGS. 6 to 8.

Figure 1:
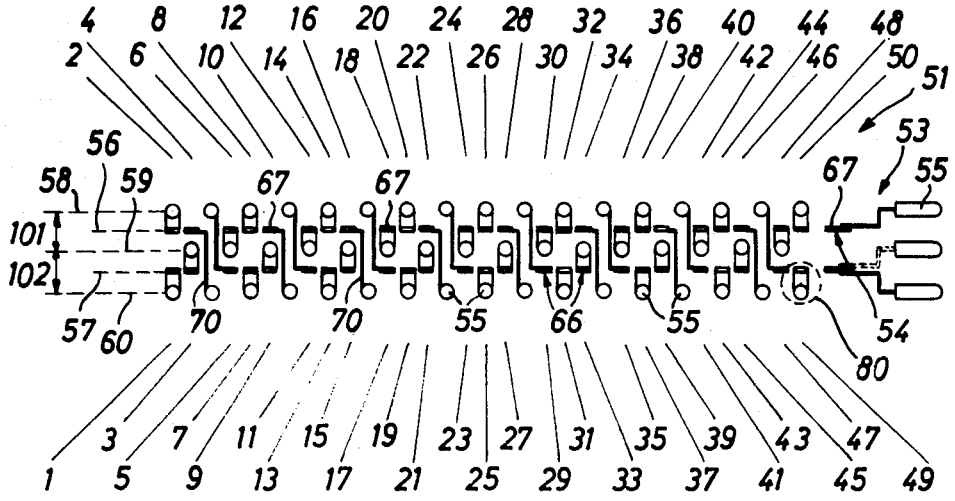
FIG. 1 is a schematic representation of an elongate connector of the invention.

At the outset the basic concept of the invention will be explained specifically referring to FIG. 1. The connector 51 shown schematically in FIG. 1 comprises contact elements which are generally referred to by reference numeral 53 and which are numbered from 1 to 50. As is shown in the right hand portion of FIG. 1 and specifically in FIG. 5, each contact element 53 comprises a plug-in element 55 and a termination element 54. The connection between the plug-in element 55 and the termination element 54 is created by connecting means 61 (see FIG. 5). Preferably, the termination element 54 is an insulation displacement means or contact. For this reason, the following description will generally refer to the termination element as an insulation displacement contact. Plug-in elements 55 project away from the plug-in side of connector 51, and they extend out of the plane of the paper in the representation of FIG. 1. The insulation displacement contacts 54 are provided at the termination side of connector 51 and consequently project downwardly from the plane of the paper in FIG. 1. Plug-in element 55 can either be a pin (male contact) or a female contact (or socket). For reasons of simplicity the following description will refer to the plug-in element 55 by using the word "pin".

The invention starts from a so-called three-row connector 51, i.e. a connector having pins 55 arranged in three rows 58, 59 and 60 which extend parallel to each other. In accordance with this invention in such a connector 51 the insulation displacement contacts 54 are arranged in two rows 56 and 57 which preferably extend parallel to each other. More particularly, the rows 56 and 57 of the insulation displacement contacts are arranged in the manner shown in FIG. 1, i.e. midways between each two rows of the rows on pins. Generally, however, it is also possible to provide the one row of termination means preferably in the area 101 between the two rows 58 and 59 of pins, while the other row 57 of termination means is arranged in the area 102 which is defined between the two rows 59 and 60 of pins. The connecting means 61 of the invention which are required for this purpose have shapes described below.

One mode of termination for a flat cable is the so-called insulation displacement technique. According to this technique termination means in the form of insulation displacement contacts are used. Inasmuch as the customary flat cables have a predetermined wire pitch or distance of $t_1$ (in practice $t_1=1.27$ mm), it is necessary that the insulation displacement contacts 54 are arranged with pitch $t_1$ in the connector. On the other hand, the distance or pitch of the contacts at the plug-in side is $t_2=2.80$ mm. This means that the pins 55 of each row 58, 59 of contacts have to have a distance of $t_2=2.80$ mm. The adaptation between the contact pitch $t_2=2.80$ mm and $t_2/2=1.40$ mm, respectively, on the plug-in side and the predetermined wire pitch $t_1=1.27$ mm on the termination side is effected by the contact elements 53, specifically the connecting means 61 of the contact elements 53.

The present invention relates in particular to a connector of the DIN 41652 type, i.e. a connector in which the pins 55 in the outermost rows 58 and 60 of contact elements are aligned with each other, while the pins 55 in the middle row 59 of contacts are centrally offset with respect to the pins 55 of the two outermost rows 58 and 60 of contacts. The amount of offset corresponds to half the distance ($t_2/2$) of adjacent contact pins 55. Such a connector is known as a trapezoidal or D-connector due to the shape of the plug-in side of the connector, which prevents mismating.

As already mentioned, the adaption between the contact distance (contact pitch) and the different cable distance (cable pitch) is achieved within the connector, and according to the invention the three-row "image" of the pins of the connector 51 is transformed into a two-row termination pitch arrangement.

Figure 2:
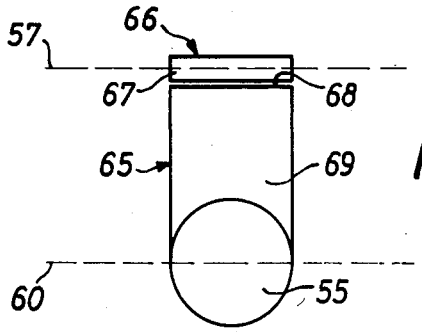
FIG. 2 shows a detail 80 of FIG. 1.
Figure 3:
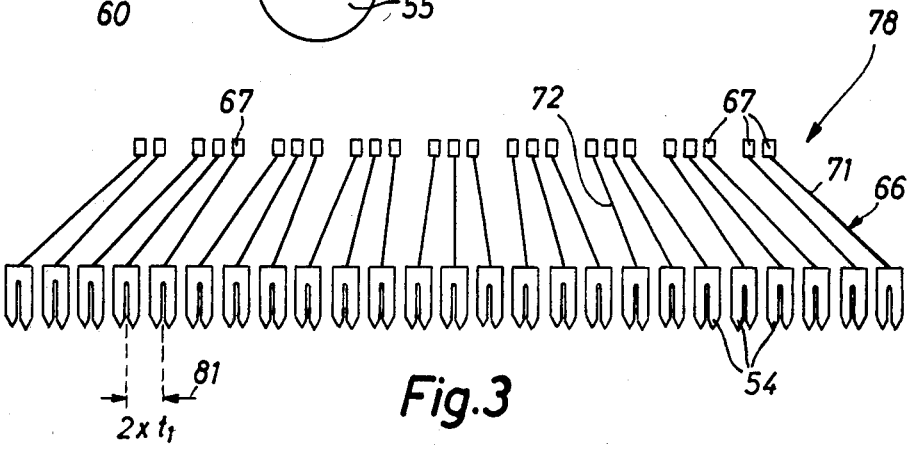
FIG. 3 is a schematic representation of a comb of insulation displacement means adapted for use in a connector of FIG. 1.

A first embodiment of the invention will be discussed in connection with FIGS. 1 to 5. In FIG. 1 the connector 51 of the invention is shown in a schematic top plan view. FIG. 2 discloses a detail of FIG. 1 and FIG. 3 shows an insulation displacement contact comb 78. Only the termination means 67 of contact comb 78 are shown in FIG. 1. It should be noted that the position of the termination means 67 in FIG. 1 does not correspond to the position of the corresponding insulation displacement contacts 54. In fact, the insulation displacement contacts 54 are offset with respect to the corresponding termination means 67 in the manner shown in FIG. 3 as described below.

Figure 4:
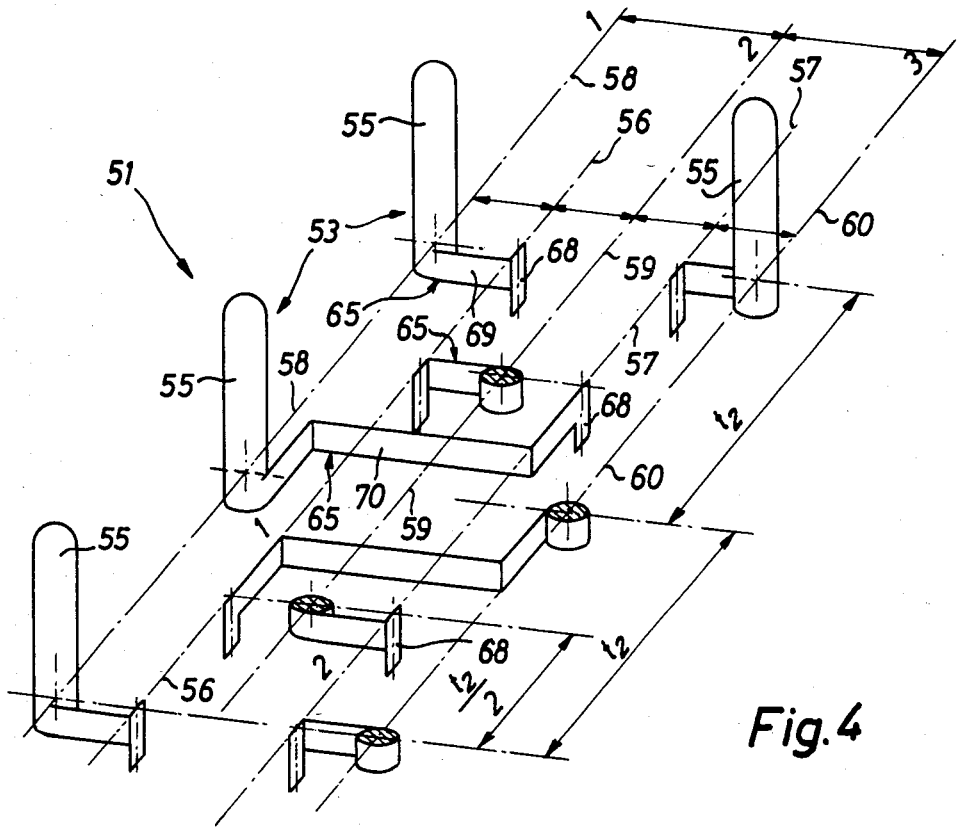
FIG. 4 is an isometric schematic partial view of the connector seen from its plug-in side.
Figure 5:
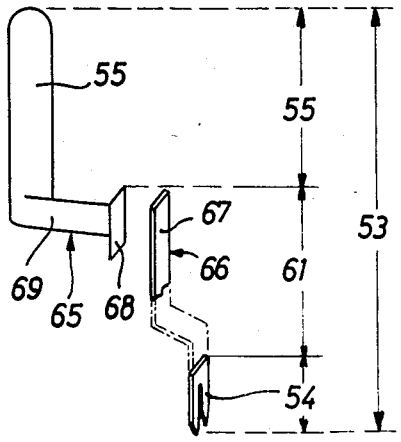
FIG. 5 is an isometric schematic representation of a contact of the type shown in FIG. 4.

FIG. 4 shows in a schematic isometric representation a part of the plug-in end of the connector 51. FIG. 5 discloses the design of a contact element which comprises, as was already mentioned, a plug-in element (pin) 55 and an insulation displacement contact 54 with connecting means 61 providing the electrical connection between pin 55 and insulation displacement contact 54. The connecting means 61 comprises pin side connecting means 65 and connecting means 66 on the side of the insulation displacement contact. Connecting means 66 comprises a connecting member 67 which can be mounted at a connecting member 68 of the pin side connecting means 65. This connection can be provided by a resistance welding operation or by soldering, or any other suitable process.

Referring again to FIG. 3 it can be recognized that connecting means 66 are provided with connecting legs having different lengths. Two of the connecting legs are referred to by reference numerals 71 and 72. Reference numeral 81 in FIG. 3 refers to the distance (pitch) of the insulation displacement contacts 54. Distance 81 corresponds to two times $t_1$, i.e. twice the distance or pitch of the wires. Such a comb 78 made up of insulation displacement contacts can be stamped out of a piece of sheet metal. After comb 78 is inserted into the insulated body of the connector (not shown in FIG. 3), and after connecting the connecting member 67 with the corresponding connecting members 68, those parts of comb 78 which keep comb 78 together (but which are not shown in FIG. 3) can be removed, so that no connection remains between individual insulation displacement contacts. It will be recognized that connecting members 67 are arranged in a plurality of groups of three insulation displacement contacts, which groups are surrounded by two groups of each two insulation displacement contacts. This is an arrangement which is required for the general arrangement of FIG. 1. It should be noted that two combs 78 of insulation displacement contacts are placed in an insulating body (not shown) in such a manner that the insulation displacement contacts 54 in the two rows 56, 57 of insulation displacement contacts are offset by the distance $t_1=1.27$ mm of the wires.

FIGS. 2 and 4 relate to a specific design of the connecting means 65 on the pin side. Two different kinds of pin side connecting means 65 are provided. There are pins 55 having short connecting legs 69 (shown in FIG. 2), and there are pins 55 having long copnnecting legs 70 (see FIG. 4). Pins 55 having a short connecting leg are required for the outermost rows 58 and 60 of contact means to provide the connection to the closest rows 56 and 57, respectively, of insulation displacement contacts; the short connecting legs are also required for the entire middle row 59 of contact elements.

Pins having long connecting legs 70 are required for every second position in the outer rows 57, 58 of contacts to provide connection not for the closest row of termination means, but for the oppositely located row 56 and 57, respectively, of insulation displacement contacts.

It will be recognized in FIG. 4 that one row 56 of the two rows of insulation displacement contacts is located in the area 101 defined between the first and second row 58, 59 of contact elements (see FIG. 1), and that the other row 57 of insulation displacement contacts is located in the area 102 defined by the second and third row 59, 60 of contact elements. As seen in a plan view it should be noted that the two rows 56 and 57 of insulation displacement contacts are located centrally between the three rows 58, 59, 60 of contact elements.

Figure 6:
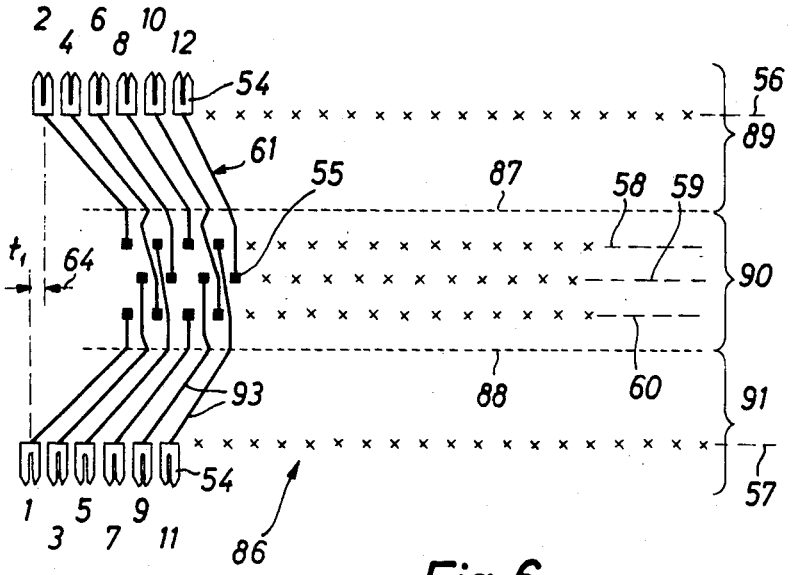
FIG. 6 is a schematic representation of a second embodiment of a connector of the invention.
Figure 7:
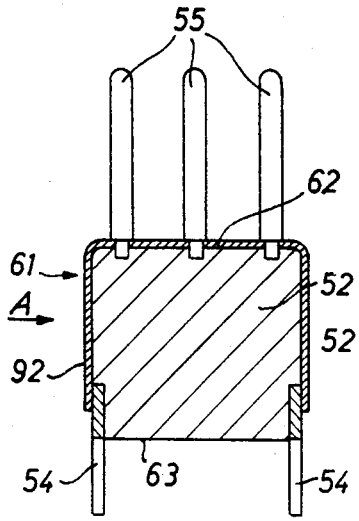
FIG. 7 is a cross-sectional view of the embodiment of FIG. 6.
Figure 8:
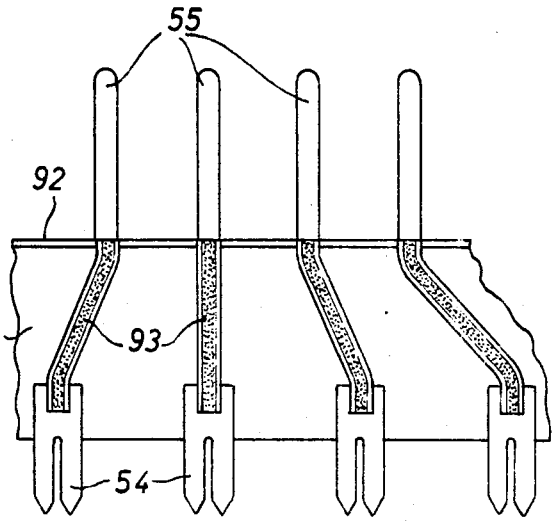
FIG. 8 is a view seen from the direction A in FIG. 7.

Referring now to FIGS. 6 through 8 another embodiment of the invention will be described. FIG. 6 discloses in a very schematic representation a connector 86. As before, connector 86 comprises on its plug-in side plug-in elements 55 arranged in three rows 58, 59, 60. As was explained in connection with the first embodiment, these plug-in elements may be either male contacts (pins) or female contacts (sockets). For reasons of simplicity the following descriptions will only refer to pins 55. In FIG. 6 only some of the pins 55 are shown and the positions of the remaining pins are referred to by appropriate crosses.

FIG. 6 illustrates schematically the arrangement of the insulation displacement contacts 54. The insulation displacement contacts as shown are referred to by reference numerals 1 through 12. Otherwise, the positions of the insulation displacement contacts are referred to by small crosses. The insulation displacement means 54 are arranged in two rows 56 and 57. The representation of FIG. 6 refers to a connector and consequently, the view of the backside 89 should be folded along folding line 87 by 90° downwardly and the view of the frontside 91 should be folded along folding line 88 by 90° downwardly. Then the plan view 90 facing upwardly would remain, i.e. the view onto a body, for instance, an insulating body of a certain design with pins 55 extending upwardly.

For the connector 86 the connecting means 61 between the pins 55 and the insulation displacement contacts 54 are provided in the form of a circuit board. The circuit board is referred to by reference numeral 92 and is shown in more detail in FIG. 7. The circuit board is flexible and comprises the connecting paths 93 as shown in FIG. 6. The plug-in elements (pin or socket) as well as the termination elements (preferably insulation displacement termination contacts) are manufactured independently of circuit board 92 by stamping. The mentioned connecting paths 93 are connected with the pins 55 and the insulation displacement contacts 54, respectively, in an appropriate manner, for instance by soldering.

FIG. 7 discloses the arrangement of a flexible circuit board 92 at an insulation body 52 which is shown in cross-section. Also the plug-in side is referred to by reference numeral 62 and the termination side is referred to by reference numeral 63. The insulating body 52 is of elongate design.

In accordance with another embodiment the circuit board can be of unitary or integral design, for instance, manufactured in accordance with the so-called dry additive process, in which a circuit board as well as circuit paths are provided by the effects of heat and pressure, and conductive particles are used which are melted into board. In such a situation the pins are anchored in the circuit board. Starting at the positions of the pins conductive paths extend in the circuit board in accordance with the schematic representation of FIG. 1 to the outer longitudinal edges and from there on two planes parallel to the direction in which the connector is plugged-in towards the termination means. The termination means are also anchored in the perpendicular part of the circuit board.

The present invention thus provides a multi-row connector, preferably of the trapezoidal or D-shape, in which three rows of contacts are provided on the plug-in side and two rows of insulation displacement contacts are provided on the wire termination side. The plug-in side of the connector conforms to a standard connector design, such as German Industrial Standard DIN 41652.

The present connector can be manufactured at low cost and with a minimum amount of material, and uses a small number of low cost standard components. The connector does not require otherwise unused space when employing insulation displacement contacts. The female contact elements may have two legs as opposed to a single leg. The present invention achieves a reduction of about 50% in the amount of material that is utilized for the contacts.

What is claimed is:

1. A connector having a plug-in or connecting side and a termination side substantially oppositely facing to the plug-in side, said termination side being adapted for flat cable termination, said connector comprising a plurality of contact elements, each of said contact elements comprising a plug-in element on the plug-in side of the connector, insulation displacement means comprising a plurality of insulation displacement contacts on the termination side of the connector and connecting means arranged between and electrically joining said plug-in elements and said insulation displacement contacts, characterized in that said plug-in elements are arranged in the form of three parallel rows on the plug-in side, and said insulation displacement contacts are arranged in two parallel rows on the termination side, the plug-in elements in all said three rows being electrically joined by said connecting means to said insulation displacement contacts in said two rows and said three rows also extending in parallel relationship to said two rows.

2. The connector of claim 1 wherein said connector is an elongate connector and said contact elements are arranged in an elongate insulation body.

3. The connector of claim 2 wherein the connector is a D connector.

4. The connector of claim 2 wherein the adaptation between the pitch $t_2$ of the plug-in contacts and the pitch $t_1$ of the wires of a flat cable to be terminated by said connector is provided within said connector, with $t_2$ being different from $t_1$.

5. The connector of claim 4 wherein the connecting means provide the adaptation between the pitch of the plug-in contacts and the pitch of the cable.

6. The connector of claim 4 wherein said insulation displacement contacts are provided in two rows, each row having a distance between adjacent contacts of $2 \times t_1$.

7. The connector of claim 6 wherein said two rows of insulation displacement contacts are offset with respect to each other by the cable pitch $t_1$.

8. The connector of claim 7 wherein one row of insulation displacement contacts is arranged in an area formed between the first and second rows of said plug-in elements and the other row of insulation displacement contacts is arranged in an area defined between the second and third rows of plug-in elements.

9. The connector of claim 8 wherein in a plan view the two rows of insulation displacement contacts are each arranged midway between its corresponding two rows of plug-in elements.

10. The connector of claim 6 wherein the connecting means is defined by a first connecting means located on a side of each plug-in element and a second connecting means located on a side of each insulation displacement contact, said first and second connecting means being adapted to be connected to each other.

11. The connector of claim 10 wherein the connecting means located on the side of the insulation displacement contacts is integrally formed with said insulation displacement contacts.

12. The connector of claim 11 wherein each row of insulation displacement contacts are connected by connecting legs, which legs are disposed in a single plane, to termination means, which in turn are provided for mounting to the connecting means located on the pin side of the connector.

13. The connector of claim 10 wherein the connecting means on the plug-in side comprise connecting legs.

14. The connector of claim 13 wherein short and long connecting legs are provided.

15. The connector of claim 14 wherein plug-in elements having short connecting legs are used in the outer rows of contact elements for connecting to the immediately adjacent rows of insulation displacement contacts and are used for all positions of the middle row of contact elements.

16. The connector of claim 15 wherein the plug-in elements having a long connecting leg are used for every second position of the outer rows of contact elements.

17. The connector of claim 14 wherein the connecting legs are provided at their free ends with connecting members, said connecting members being fixedly connected to the corresponding connecting members.

18. The connector of claim 5 wherein said connecting means are formed by a circuit board.

19. The connector of claim 18 wherein the circuit board is a flexible circuit board.

20. The connector of claim 18 wherein the plug-in elements located on the plug-in side are formed by stamping and are connected with the circuit board.

* * * * *